US005746669A

United States Patent [19]

Sinsheimer et al.

[11] Patent Number: 5,746,669

[45] Date of Patent: May 5, 1998

[54] GAME AND TRAINING DEVICE FOR TEACHING SOCCER SKILLS

[75] Inventors: Michael N. Sinsheimer, 1723 Beverly Dr., Charlotte, N.C. 28207; Richard W. Turner, Charlotte, N.C.; Holger Schleife, Berlin, Germany

[73] Assignee: Michael N. Sinsheimer, Charlotte, N.C.

[21] Appl. No.: 751,298

[22] Filed: Oct. 31, 1996

[51] Int. Cl.[6] ..... A63B 69/00

[52] U.S. Cl. ..... 473/446; 273/118 R; 273/402; 473/411

[58] Field of Search ..... 473/446, 410, 473/411, 412, 472, 473; 273/118 R, 398, 400, 401, 402

[56] References Cited

U.S. PATENT DOCUMENTS

| | | | |
|---|---|---|---|
| D. 235,897 | 7/1975 | Breneman . | |
| 850,224 | 4/1907 | Haskell . | |
| 878,309 | 2/1908 | Pell et al. . | |
| 1,166,496 | 1/1916 | Torrey . | |
| 1,566,945 | 12/1925 | Winkley . | |
| 1,784,818 | 12/1930 | Bump | 473/410 |
| 1,936,220 | 11/1933 | Ziebarth | 473/411 |
| 2,986,398 | 5/1961 | Oliver . | |
| 3,836,147 | 9/1974 | Shapiro . | |
| 3,865,375 | 2/1975 | Casegrove | 273/118 R |
| 4,071,241 | 1/1978 | Garcia . | |
| 4,286,786 | 9/1981 | Papadopoulos | 273/296 |
| 4,295,648 | 10/1981 | Stromback | 273/402 X |
| 4,619,455 | 10/1986 | Quraishi | 273/118 R |
| 4,720,095 | 1/1988 | Sowards . | |
| 4,822,053 | 4/1989 | Flaherty | 473/473 |
| 4,878,671 | 11/1989 | Gubany . | |
| 4,921,257 | 5/1990 | Heller . | |
| 5,037,113 | 8/1991 | Sowards . | |
| 5,042,813 | 8/1991 | Huang . | |
| 5,062,640 | 11/1991 | Haley . | |
| 5,242,164 | 9/1993 | Nicoll . | |
| 5,280,922 | 1/1994 | Jones . | |
| 5,308,083 | 5/1994 | Grunfeld et al. | 273/400 |
| 5,402,999 | 4/1995 | Keehn, Sr. | 473/472 |
| 5,435,572 | 7/1995 | Covel . | |
| 5,449,170 | 9/1995 | Clements | 273/127 B X |
| 5,516,115 | 5/1996 | McLain | 273/401 |

FOREIGN PATENT DOCUMENTS

| | | |
|---|---|---|
| 6-285200 | 10/1994 | Japan . |
| 18900 | of 1901 | United Kingdom . |

*Primary Examiner*—William H. Grieb

*Attorney, Agent, or Firm*—Bell Seltzer Intellectual Property Law Group of Alston & Bird LLP

[57] ABSTRACT

The present invention provides a game and training device which can be played in a game-like setting to develop skills such as ball handling, passing, and shooting. A primary goal forms a target opening in a generally vertical plane through which a ball may be kicked by the player. In addition, a plurality of intermediate goals are arranged on the playing field in spaced relation to one another. Each intermediate goal defines a respective target opening through which the ball is to be passed as the player advances the ball to the primary goal. Each intermediate goal comprises a pair of base members positioned on laterally spaced apart relation to one another and a hoop member supported by the pair of base members.

20 Claims, 6 Drawing Sheets

GAME AND TRAINING DEVICE FOR TEACHING SOCCER SKILLS

FIELD OF THE INVENTION

This invention relates to sports education, and more particularly to a device for teaching soccer skills to a player.

BACKGROUND OF THE INVENTION

Soccer is a game that is actively enjoyed by a large segment of the population. Soccer has been played widely worldwide, and studies report that the sport currently enjoys a rapid growth rate in the United States. Soccer is enjoying an especially rapid growth among participants under 18 years of age.

Traditionally, soccer is taught through drills which emphasize various soccer skills and through actual playing practice. Although drills can be quite effective in developing soccer skills, younger players typically do not find skills drills to be enjoyable and they are not prone to practice the drills outside of a structured coaching environment.

It is an object of the present invention to provide a training device which will teach soccer skills in a fun game-like environment. The product of the present invention is designed to be enjoyable for children to play alone, with friends, or with a parent. Indeed, the product is designed to allow parents to participate with their children in a game-like setting which will enhance the child's skills in soccer.

SUMMARY OF THE INVENTION

The product of the present invention is designed for use on a playing field for teaching soccer skills to a player, especially to youth and to children. The product can be played in a game-like setting and develops ball handling, passing and shooting skills.

The present invention includes a primary goal which forms a target opening in a generally vertical plane which through a soccer ball may be kicked by the player. In addition, a plurality of intermediate goals are arranged on the playing field in spaced relation to one another and in spaced relation to the primary goal. Each intermediate goal defines a respective target opening through which the soccer ball is to be passed as the player advances the soccer ball to the primary goal. Each intermediate goal comprises a pair of base members positioned in laterally spaced apart relation to one another and a hoop member supported by the pair of base members. The hoop member includes upright portions extending respectively from the base member and a medial portion extending laterally between and interconnecting the upright portions, the upright portions and the medial portion thus defining a target opening.

In a preferred form of the invention, a target disk is carried by the medial portion of the hoop and is located within the target opening of the intermediate goal. The target disk is mounted for movement relative to the hoop so that the disk is deflected by a ball passing through the target opening.

In one specific embodiment of the invention, the hoop member comprises two substantially identically shaped pieces which are releasably fitted together, for example by a snap fit connection, to form the pair of upright portions and the medial portions of the intermediate goal. The base members each include a foot having a lower side for engaging the playing field and a socket for releasably receiving an end of said upright portion of said hoop. In one embodiment, the foot is hollow and includes a fill opening to permit filling the foot with a weighting substance, such as sand or water, for anchoring the base member on a hard playing field. In another embodiment, a ground spike is provided and the foot has a corresponding opening for receiving the ground spike and for thus anchoring the base member on a turf playing field.

The primary goal likewise comprises a pair of base members positioned in laterally spaced apart in relation to one another, and a hoop member supported by the pair of base members. The hoop member includes upright portions extending respectively from the base members and a medial portion extending between and interconnecting the upright portions, the upright portions and the medial portions thus defining a target opening in a generally vertical plane for receiving a soccer ball kicked by the player.

BRIEF DESCRIPTION OF THE DRAWINGS

Some of the features and advantages of the invention having been stated, others will become apparent from the detailed description which follows and from the accompanying drawings, in which.

DESCRIPTION OF THE ILLUSTRATED EMBODIMENTS

Figure 1:
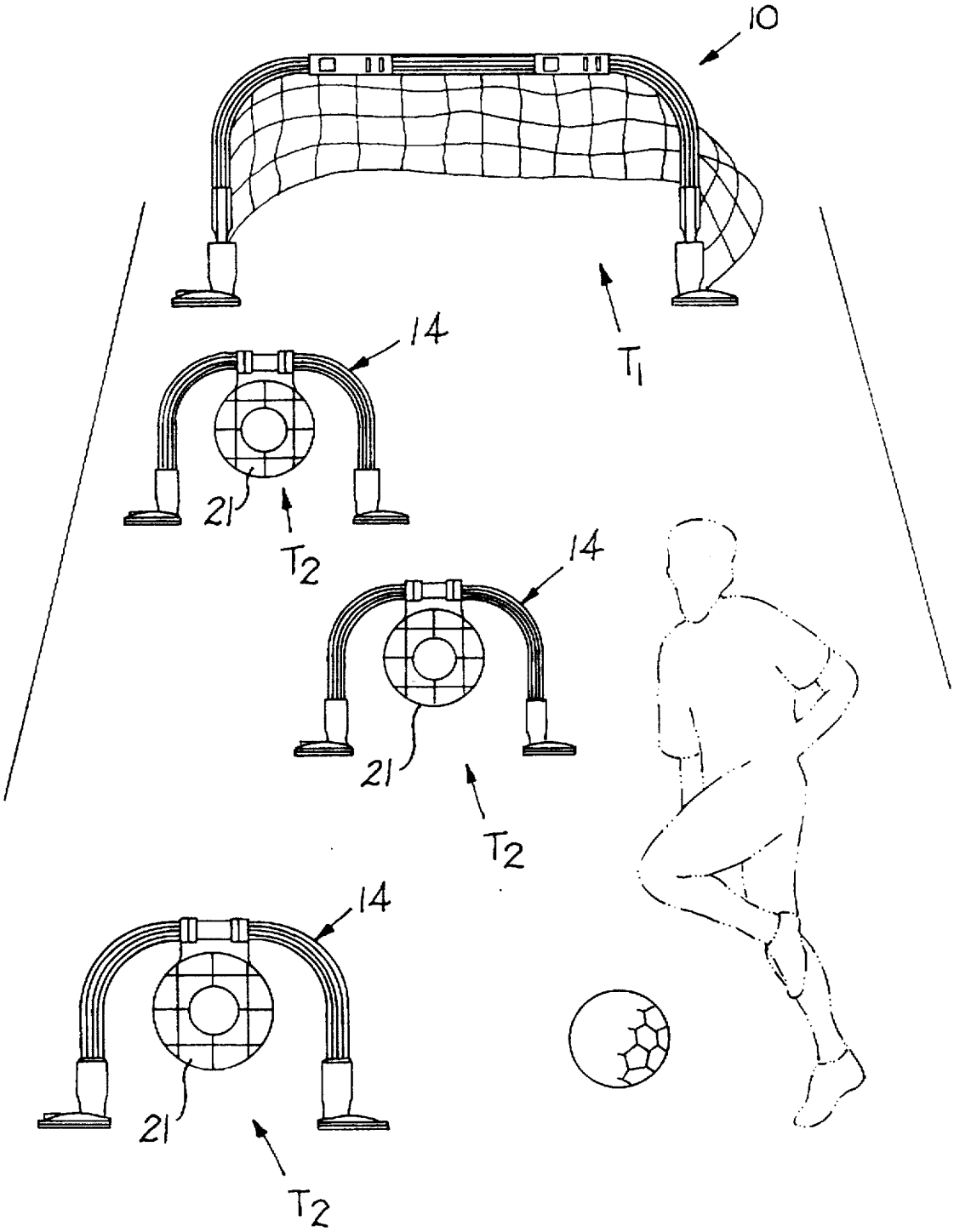
FIG. 1 is a perspective view, not to scale, showing the game and training device of the present invention, including a primary goal and several intermediate goals.

FIG. 1 illustrates how the various components of the game and training device of the present invention may be arranged on a playing field for teaching soccer skills. It is to be understood that the various components shown, and the soccer player, shown in phantom lines, are not to scale. As shown, a primary goal, generally indicated at 10, is positioned on the playing field and forms a target opening $T_1$ in a generally vertical plane through which a soccer ball may be kicked by the player. Although the present invention is not restricted to a particular size for the primary goal and target opening, the goal 10 and the target opening $T_1$ defined thereby are typically considerably smaller than the size of a regulation soccer goal.

Also provided on the playing field are a series of intermediate goals, generally indicated by the reference character 14. Each intermediate goal 14 defines a respective target opening $T_2$ through which the soccer ball is to be passed as the player advances the soccer ball to the primary goal 10. As shown, the intermediate goals 14 are arranged on the playing field in spaced relation to one another and in spaced relation to the primary goal 10. The particular arrangement of the intermediate goals on the playing field can be varied as desired in order to provide variety in the play of the game and to also assist in the development of various skills. Although the invention is not intended to be restricted to a specific size for the intermediate goals, it is desirable that the target openings for the intermediate goals 14 be relatively restricted in order to emphasize accuracy. Suitably, the target opening $T_2$ should desirably have a width of no more than about 4 soccer ball diameters and a height of no more than about 3 soccer ball diameters. More preferably, the target opening $T_2$ should have a height and width of no more than about two soccer ball diameters. For example, in one suitable embodiment the opening $T_2$ is about 15 inches wide and about 12 inches high.

Figure 2:
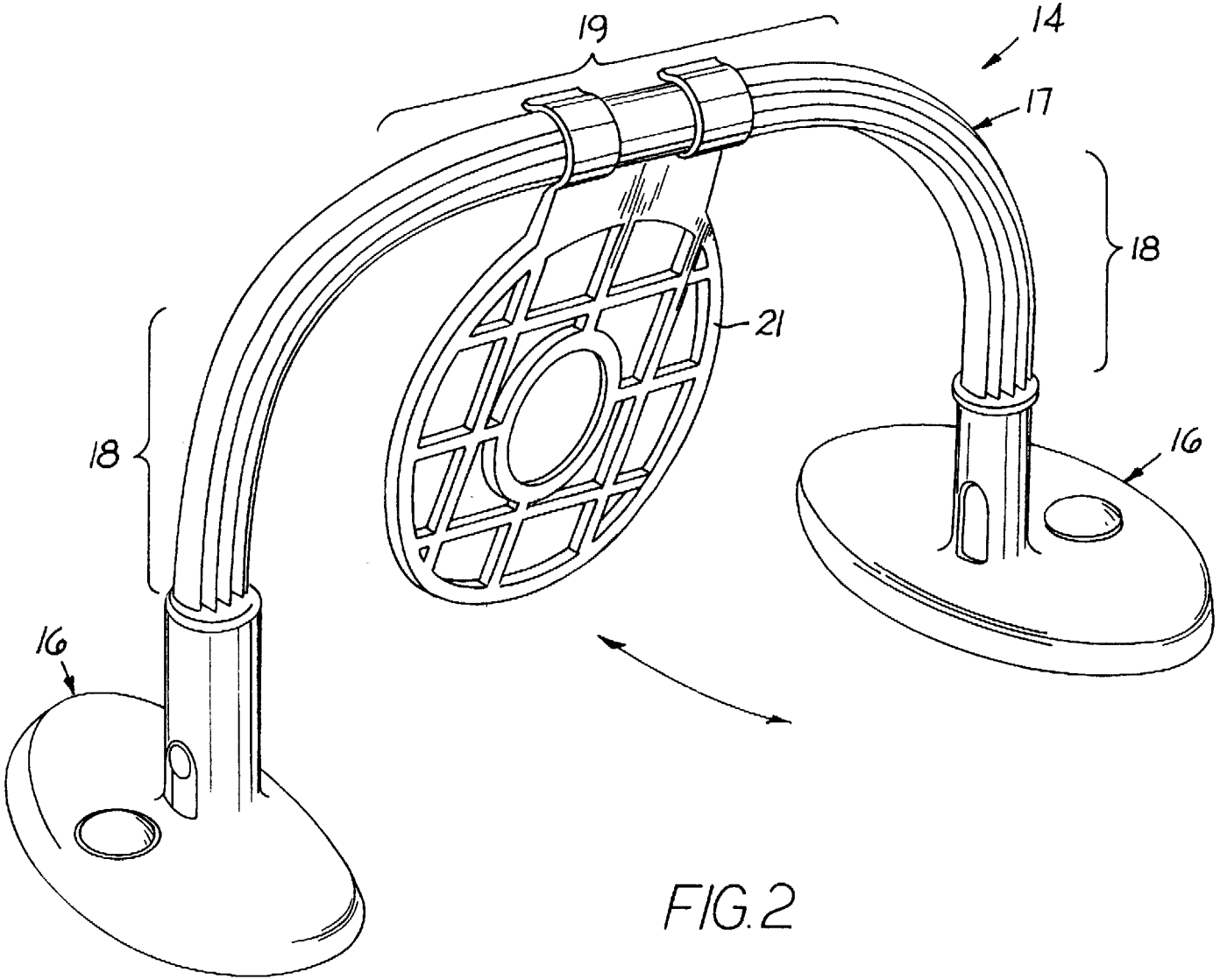
FIG. 2 is a perspective view showing one of the intermediate goals in greater detail.

As shown in greater detail in FIG. 2, each intermediate goal 14 includes a pair of base members 16 which are positioned and laterally spaced apart in relation to one another, and a hoop member, generally indicated at 17, which is supported by the respective base members 16. The hoop member includes upright portions 18 which extend respectively from the base member 16 and a medial portion 19 extending laterally between and joining the upright portions 18. The intermediate goal 14 additionally includes a target disk 21 which is suspended from the medial portion 19 of the hoop member 17 and hangs in the target opening $T_2$. The target disk 21 is freely pivotable about the axis of the medial portion 19. Thus, when a soccer ball is directed through a target opening $T_2$ with sufficient force, the target disk 21 is deflected by the ball and swings upwardly to allow the ball to pass through the target opening. This provides visual confirmation that the ball has been successfully directed through the goal and also adds visual interest to the game.

Figure 3:
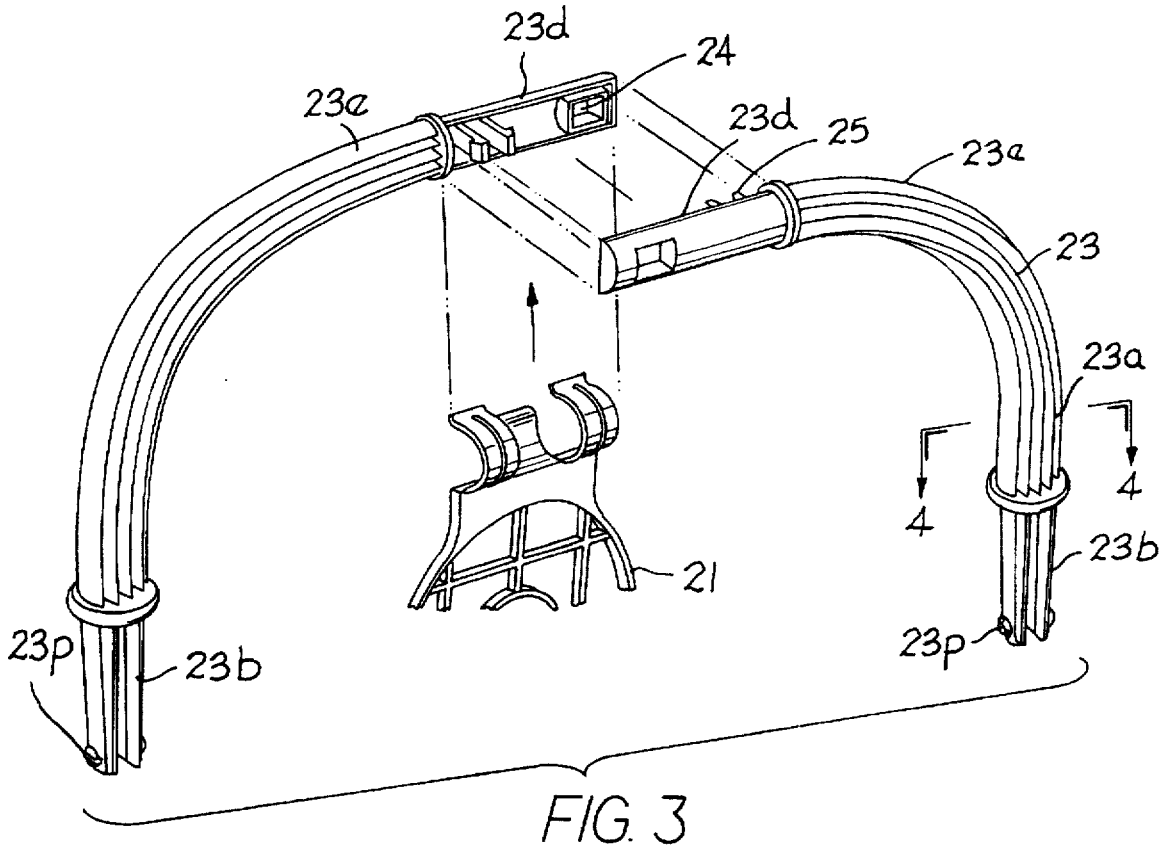
FIG. 3 is an exploded view showing the component parts of the intermediate goal of FIG. 2.

As best seen in FIG. 3, each hoop member 17 is formed from two components or pieces 23 which are of substantially identical shape. Each piece 23 is of a generally L-shaped configuration and includes an upright portion **23*a* having a lower end 23*b* adapted to be received by a base member 16 and a top portion 23*c* which extends laterally from the upper end of the upright portion. As shown, the top portion 23*c* has a reduced end portion 23*d* with a cross sectional shape configured as one half of the overall cross section of the adjacent part of the top portion 23*c*. The inner face of the reduced end portion 23*d* lies in an imaginary plane parallel to and bisecting the plane of the L-shaped configured piece 23. This arrangement allows for two identical pieces 23 to be positioned with their respective reduced end portions 23*d* in opposing relation for interconnection to form a complete hoop member. When two pieces 23 are positioned in assembled relation with the respective inner faces thereof in opposing relation, the resulting cross sectional configuration corresponds to that of the adjacent top portions 23*c*. The two assembled pieces 23 are held together in connected relation by suitable fasteners. Persons skilled in the art will recognize that various fastener arrangements could be employed for securing the pieces 23 together. In the embodiment illustrated, the pieces are adapted to be snap-fit together by a integrally formed snap-fit fasteners. More particularly, the reduced end portion 23*d* of each piece includes integrally formed openings or receptacles 24 and integrally formed projecting flexible fingers 25. The fingers 25 and openings 24 of each piece are so positioned that when the two pieces 23 are assembled, the fingers 25 of one piece are received by the corresponding openings 24 of the other piece. Each finger 25 is formed with a outwardly projecting retaining surface 25*a* adapted to engage with the walls surrounding the opening 24** on the other piece to form a releasable snap-fit connection.

Once the two pieces 23 have been assembled to form a completed hoop member 17, the target disk 21, may be snapped into place on the medial portion of the hoop member 17. To this end, it will be seen that the upper end of the target disk is provided with resilient flexible connectorizing projections 22 configured and adapted to engage opposite sides of the medial portion 19 of the hoop member 17. The connectorizing projections 22 have an arched, curved shape which define an open channel which is of the cross-sectional area corresponding to the cross-sectional area of the medial portion 19.

Figure 4:
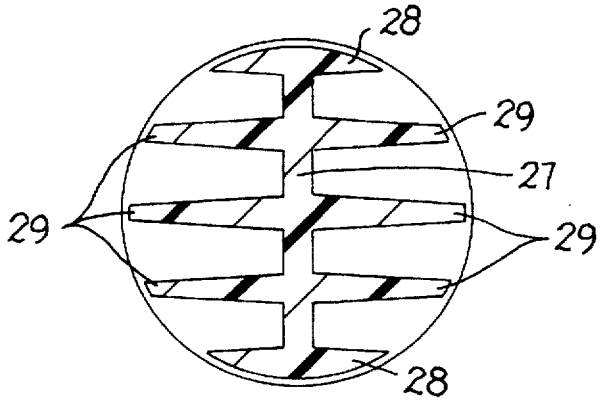
FIG. 4 is a cross-sectional view of a component of the intermediate goal taken substantially along the line 4—4 of FIG. 3.

The respective pieces 23 forming the hoop member may be formed of any suitable material and of any suitable cross-section including hollow, tubular or solid. In the preferred embodiment illustrated, the respective pieces 23 are made of molded plastic and have a solid ribbed cross-section as best seen in FIG. 4, including a central longitudinally extending web 27, rounded end fins 28 carried by opposite longitudinal edges of the central web 27, and intermediate fins 29 extending outwardly from opposite sides of the central web 28. The web 27, end fins 28 and intermediate fins 29 collectively define an overall round cross section for the piece 23. This cross-sectional configuration provides excellent strength and rigidity, while providing for ease of molding and reduced weight and material costs.

Figure 5:
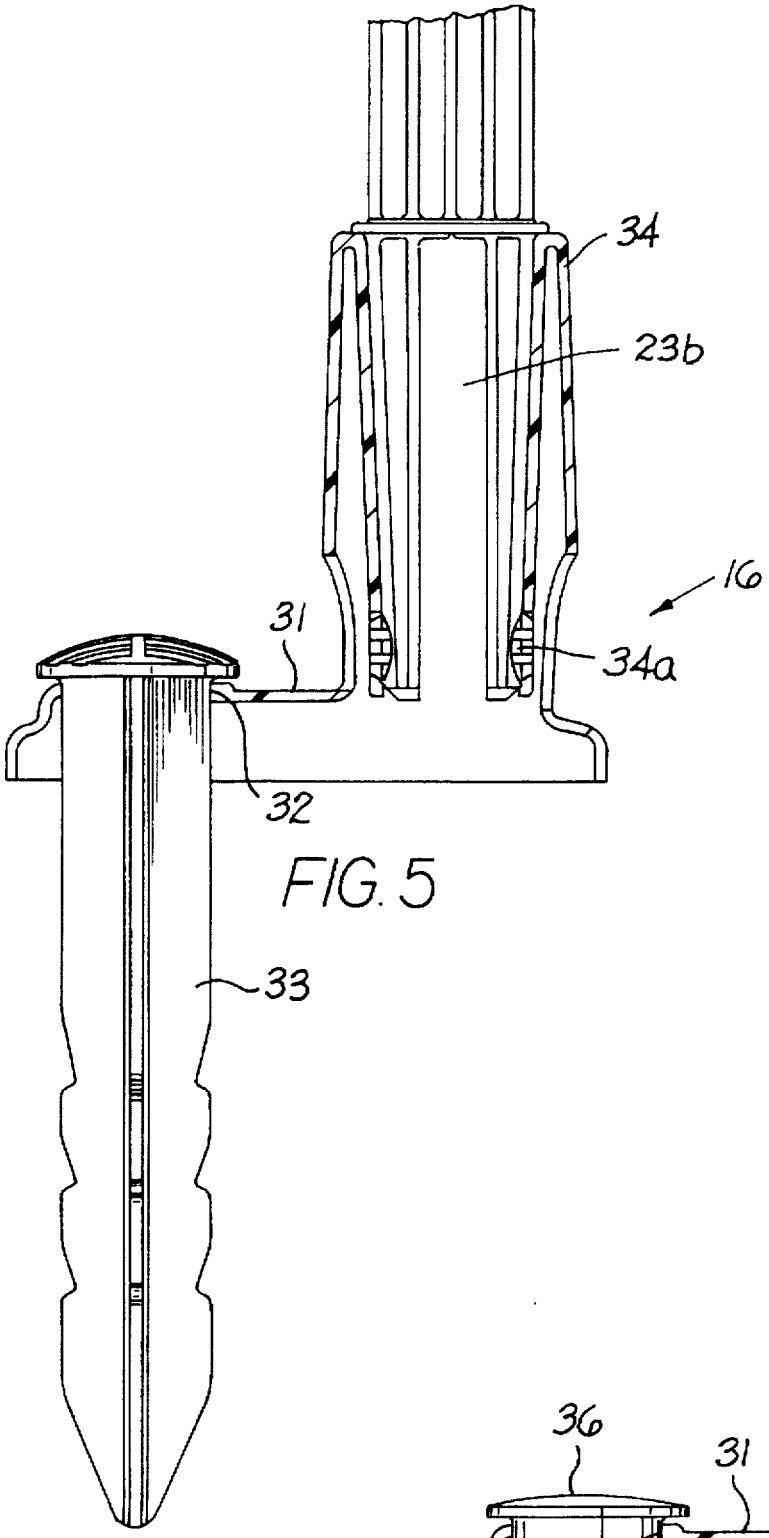
FIG. 5 is a cross-sectional detailed view of one of the feet of FIG. 2, showing how a ground spike can be used for fastening the base member to a turf playing field.
Figure 6:
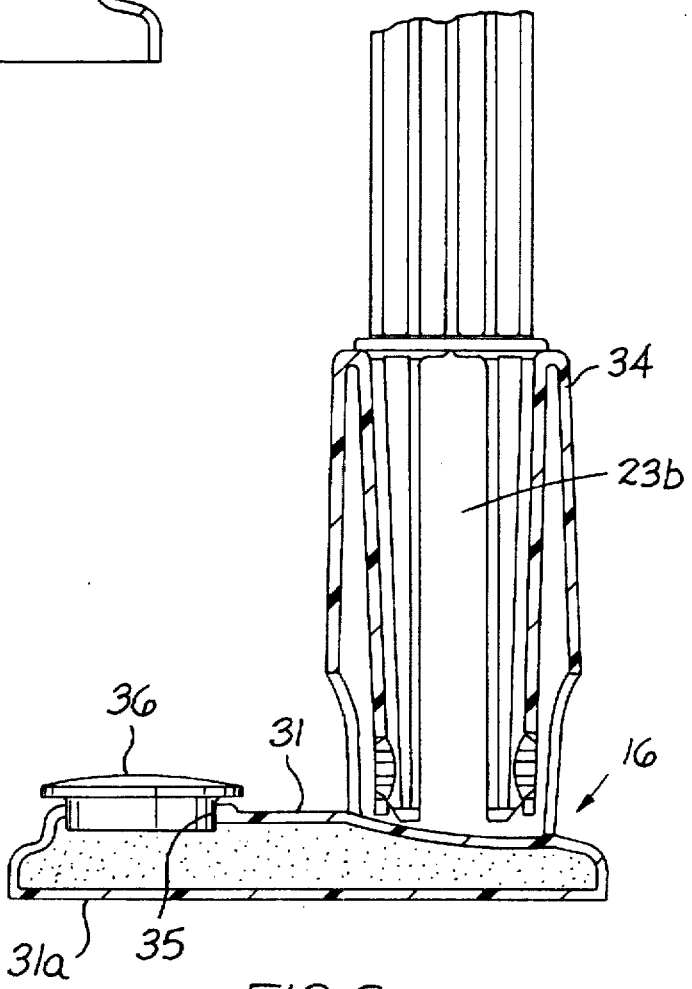
FIG. 6 is a cross-sectional view similar to FIG. 5, but showing a hollow foot which can be weighted for securing the base member to a hard surfaced playing field.

The base member 16 which supports the hoop member 17 in an upright orientation on the playing field is shown in more detail in FIGS. 5 and 6. In the embodiment shown in FIG. 5, the base member is adapted for use on a soft playing field, such as turf. As shown, the base member 16 includes a foot 31 having an opening 32 therein adapted for receiving a ground spike 33. A cylindrical sleeve 34 is carried by the foot 31 and projects upwardly therefrom. The sleeve 34 defines a generally cylindrical opening with an open upper end serving as a socket adapted for receiving the lower end **23*b* of one of the pieces 23 forming hoop member 17. The lower end 23*b* is removably received in the sleeve to facilitate set up of the game and easy disassembly and storage. The sleeve 34 and lower end 23*b* may be provided with suitable means for releasably retaining the end portion 23*b* in the sleeve 34. Thus in the embodiment shown, an inner wall surface of the sleeve 34 is provided with a small opening or detent formation 34*a* adapted to receive a correspondingly located projection formation 23*p* (FIG. 3) at the end of the lower end portion 23*b*. The sleeve 34 may be formed of a plastic material having greater flexibility and resiliency than the foot 31**, such as rubber or other elastomeric material, to serve for absorbing shocks and prevent breakage in the event of a strong blow to the hoop member by a ball or player.

The base member shown in FIG. 6 is similar to that of FIG. 5, but is adapted for use on a hard surface playing field, such as pavement, which could not be penetrated by a ground spike. In this embodiment, the foot, indicated by the reference character 31" is of a hollow configuration including a lower wall **31*a* and is provided with a fill opening 35 to allow for filling the hollow foot with a weighting substance such as sand or water. A cap 36 may be provided for sealing the fill opening 35. In other respects, the embodiment of the base member shown in FIG. 6 is similar to that previously described in connection with FIG. 5**.

Figure 7:
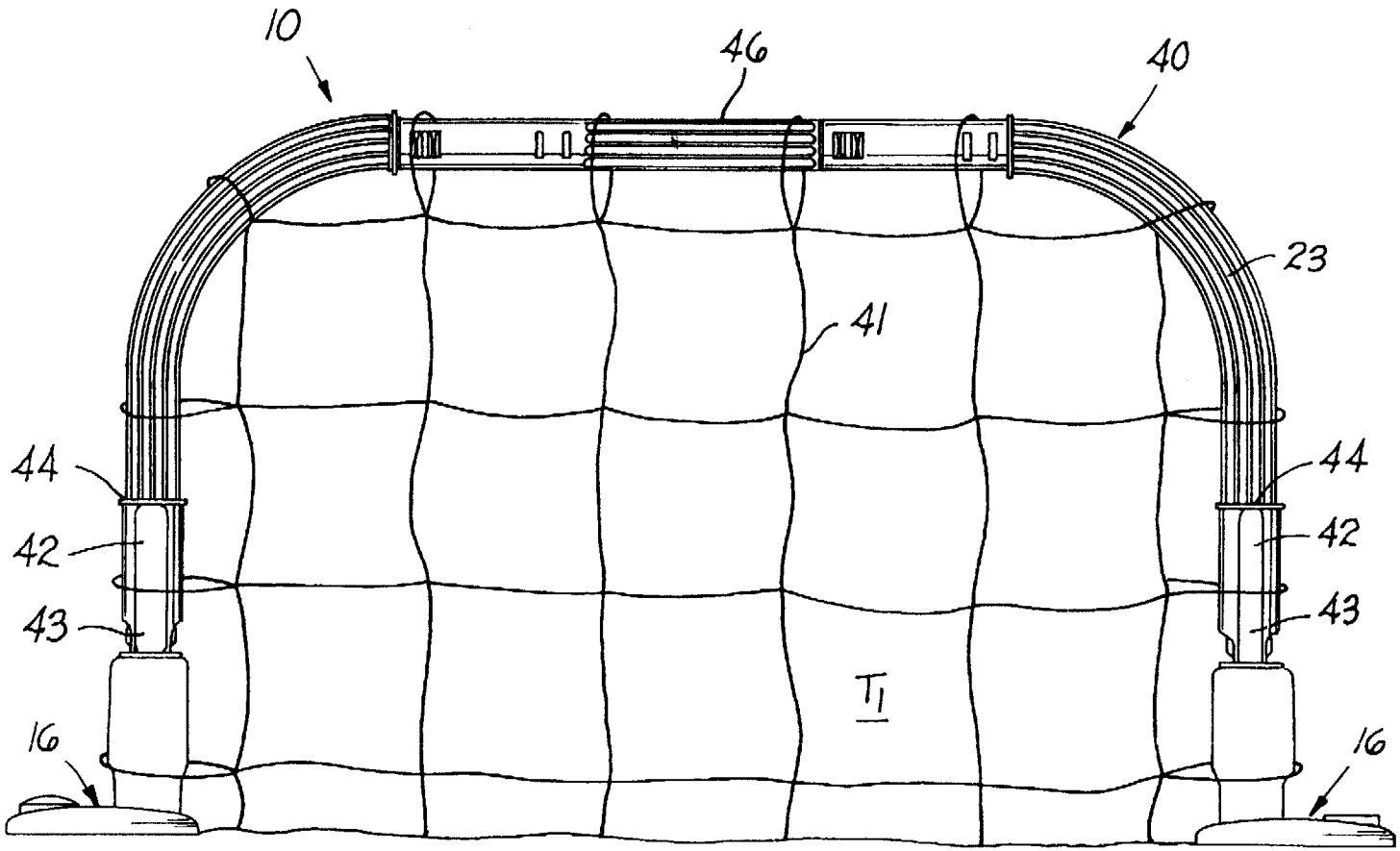
FIG. 7 is a front elevational view showing the primary goal.

FIG. 7 shows the primary goal 10 in greater detail. Like the secondary goals, the primary goal is supported by a pair of base members 16, which may suitably be of the same configuration and construction as the base members used for the intermediate goals 14. The primary goal also includes a hoop member generally indicated at 40, which is supported by the base members 16 and extends upwardly therefrom to form the target opening $T_1$. The primary goal may optionally include a net 41. The net 41 is suitably provided with loops or the like which can be skinned onto the hoop member, and rear-most portions of the net can be secured to the ground by suitable means such as a ground spike or weight. Alternatively, the goal may be used without a net or with a movable target disk, similar to the disk 21 used on the intermediate goals 14 but of larger size.

The hoop member 40 of the primary goal 10 is larger than the hoop member 17 of the secondary goals and forms a target opening $T_1$ which is a greater area than the target opening $T_2$ of the secondary goals. Preferably, the hoop member forms a target opening having a width of 3 to 10 soccer ball diameters and a height of 2 to 5 soccer ball diameters. For example, in one suitable embodiment the opening $T_1$ is about 2 feet in width and about 1¼ feet in height.

Figure 9:
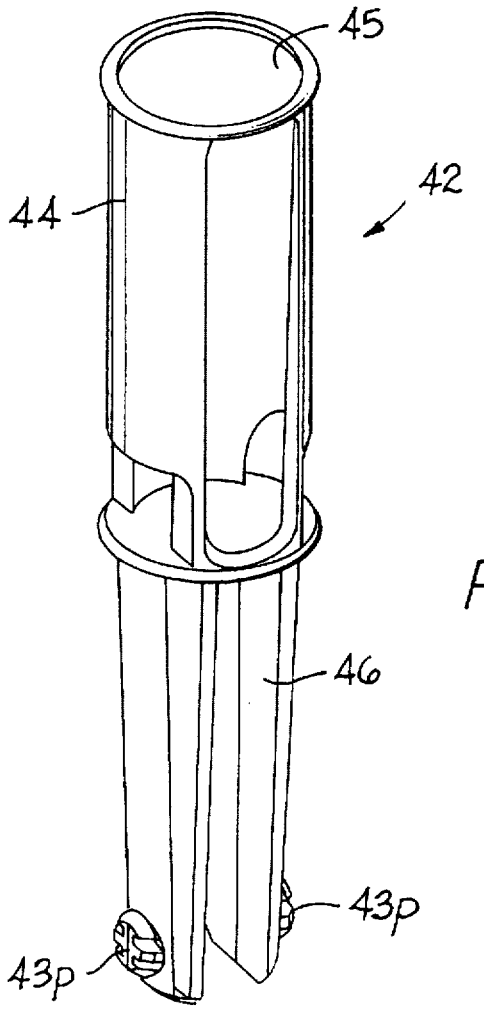

One particularly advantageous feature of the present invention is that the primary goal can use many of the same components as are used for the intermediate goals 14. Specifically, the primary goal 10 can use the same base members 16 as are used for the intermediate goals and can use the same identically configured L-shaped pieces 23 as are used in the intermediate goals. To make the hoop member 40 a larger size, extension elements are used in combination with the L-shaped pieces 23 and the base members 16. More particularly, as shown best in FIGS. 7 and 9, each primary goal may optionally utilize a pair of upright extension elements 42, each having a lower end portion 43 adapted to be received in the cylindrical sleeve 34 of the base member and an upper end portion 44 which itself has a cylindrical sleeve formation 45 therein (FIG. 9) adapted to receive a lower end **23*b* of one of the L-shaped pieces 23. The lower end portion 43 includes radially outwardly facing projection formations 43*p* adapted to engage the opening or detent formations 34*a* of sleeve 34. The upright extension element 42** may be suitably formed of a resilient flexible material, such as rubber or other elastomeric material, to additionally serve as a shock absorber in the event of a sharp force from a ball or player.

Figure 8:
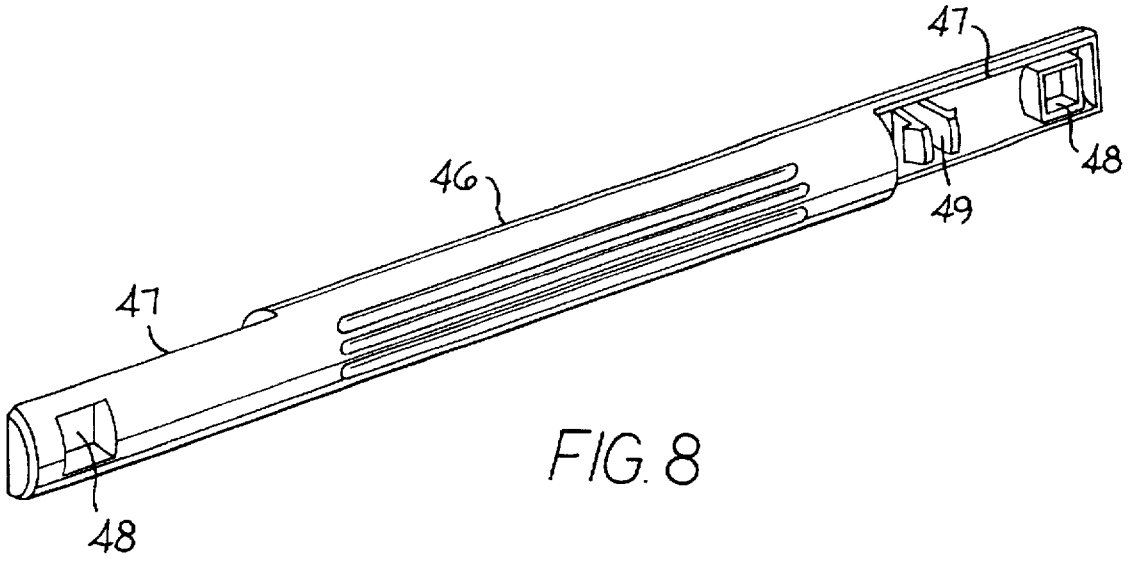
FIGS. 8 and 9 are views showing components of the primary goal in greater detail.

A lateral extension member 46 serves for interconnecting corresponding upper end portions of the L-shaped pieces 23. As shown in greater detail in FIG. 8, the lateral extension member 46 has reduced cross-section end portions 47 similar to the reduced end portions **23*d* previously described and releasable fasteners are provided to cooperate with the fasteners provided on the L-shaped pieces. More specifically, as shown, each reduced end portion 47 includes openings 48 and fingers 49 adapted to cooperate and engage with corresponding openings 24 and fingers 25** on the L-shaped pieces. By this arrangement the primary goal can be assembled for use or disassembled for storage quite easily and the entire device, including all of the component parts can be compactly stored when not in use.

Many modifications and other embodiments of the invention will come to mind to one skilled in the art to which this invention pertains having the benefit of the teachings presented in the foregoing descriptions and to the associated drawings. Therefore, it is to be understood that the invention is not to be limited to the specific embodiments disclosed. For example, it should be evident that the present invention could be utilized for playing other games besides soccer, such as roller hockey for example, and with other equipment besides a soccer ball. Although specific terms are employed, they are used in a generic and descriptive sense only and not for purposes of limitations, and that modifications and other embodiments are intended to be included within the scope of the appended claims.

That which is claimed is:

1. A game and training device for use on a playing field for teaching skills to a player, comprising a primary goal on the playing field forming a target opening in a generally vertical plane through which a ball may be kicked by the player; and a plurality of intermediate goals arranged on the playing field in spaced relation to one another and in spaced relation to said primary goal, each said intermediate goal defining a respective target opening through which the ball is to be passed as the player advances the ball to said primary goal, and each said intermediate goal comprising a pair of base members positioned in laterally spaced apart relation to one another, and a hoop member supported by said pair of base members, said hoop member including upright portions extending respectively from said base members and a medial portion extending laterally between and interconnecting said upright portions, and said hoop member comprising two substantially identically shaped pieces releasably fitted together to form said pair of upright portions and said medial portion, said upright portions and said medial portion defining said target opening.

2. A game and device as defined in claim 1, wherein each of said pieces includes a respective one of said upright portions and a corresponding half of said medial portion, said corresponding halves including mating surfaces and cooperating releasable fasteners.

3. A game and device as defined in claim 2, wherein said releasable fasteners comprises integrally formed snap-fit fasteners.

4. A game and device as defined in claim 1, wherein said base members each include a foot having a lower side for engaging the playing field and a socket for releasably receiving an end of said upright portion of said hoop.

5. A game and device as defined in claim 4, wherein said foot is hollow and includes a fill opening to permit filling the foot with a weighing substance for anchoring the base member on a hard playing field.

6. A game and device as defined in claim 4, including a ground spike, and wherein said foot has an opening therethrough for receiving said ground spike for anchoring the base member on a turf playing field.

7. A game and training device for use on a playing field for teaching skills to a player, comprising a primary goal on the playing field forming a target opening in a generally vertical plane through which a ball may be kicked by the player; and a plurality of intermediate goals arranged on the playing field in spaced relation to one another and in spaced relation to said primary goal, each said intermediate goal defining a respective target opening through which the ball is to be passed as the player advances the ball to said primary goal, each said intermediate goal comprising a pair of base members positioned in laterally spaced apart relation to one another, and a hoop member supported by said pair of base members, said hoop member including upright portions extending respectively from said base members and a medial portion extending laterally between and interconnecting said upright portions, said upright portions and said medial portion defining said target opening, and a target disk carried by said medial portion of said hoop member and located within said target opening, said target disk being mounted for movement relative to said hoop and being so positioned and arranged that the disk is deflected by a ball passing through said target opening.

8. A game and training device for use on a playing field for teaching skills to a player, comprising a primary goal on the playing field forming a target opening in a generally vertical plane through which a ball may be kicked by the player; and a plurality of intermediate goals arranged on the playing field in spaced relation to one another and in spaced relation to said primary goal, each said intermediate goal defining a respective target opening through which the ball is to be passed as the player advances the ball to said primary goal, each said intermediate goal comprising a pair of base members positioned in laterally spaced apart relation to one another, and a hoop member supported by said pair of base members, said hoop member including upright portions extending respectively from said base members and a medial portion extending laterally between and interconnecting said upright portions, said upright portions and said medial portion defining said target opening, and wherein each said primary goal comprises a pair of base members positioned in laterally spaced apart relation to one another, and a hoop member supported by said pair of base members, said hoop member including upright portions extending respectively from said base members and a medial portion extending laterally between and interconnecting said upright portions, said upright portions and said medial portion defining a target opening in a generally vertical plane for receiving a ball kicked by the player.

9. A game and device as defined in claim 8, wherein said hoop member of said secondary goal and said hoop member of said primary goal each comprises two substantially identically shaped and interchangeable pieces which form said pair of upright portions and said medial portion.

10. A game and device as defined in claim 9, wherein each of said pieces includes a respective one of said upright portions and a corresponding part of said medial portion, said corresponding parts including mating surfaces and cooperating releasable fasteners, said pieces being connected directly to one another in said secondary goal, and said pieces being connected to an extension piece in said primary goal, such that the target opening of said primary goal is wider than the target opening of said secondary goal.

11. A game and device as defined in claim 9, wherein each of said substantially identically shaped pieces is formed of plastic and has a solid, ribbed cross-section.

12. A game and device as defined in claim 8, wherein said base members of said primary goal each include a foot having a lower side for engaging the playing field and a socket for releasably receiving an end of said upright portion of said hoop.

13. A game and device as defined in claim 12, wherein said socket comprises a resilient, flexible sleeve connected to said base and receiving said end of upright portion so that said hoop is resiliently supported by said base member for withstanding the force of a ball or player.

14. A goal for use on a playing field for teaching skills to a player, comprising a pair of base members positioned in laterally spaced apart relation to one another, and a hoop member supported by said pair of base members, said hoop member including upright portions extending respectively from said base members and a medial portion extending laterally between and interconnecting said upright portions, said upright portions and said medial portion defining a target opening, and said hoop member comprising two substantially identically shaped and interchangeable pieces releasably fitted together to form said pair of upright portions and said medial portion.

15. A goal as defined in claim 14, wherein each of said pieces includes a respective one of said upright portions and a corresponding half of said medial portion, said corresponding halves including mating surfaces and cooperating integrally formed snap-fit releasable fasteners.

16. A goal as defined in claim 15, wherein each of said substantially identically shaped pieces is formed of plastic and has a solid, ribbed cross-section.

17. A goal as defined in claim 14, wherein said base members each include a foot having a lower side for engaging the playing field and a socket for releasably receiving an end of said upright portion of said hoop.

18. A goal as defined in claim 17, wherein said foot is hollow and includes a fill opening to permit filling the foot with a weighting substance for anchoring the base member on a hard playing field.

19. A goal as defined in claim 17, including a ground spike, and wherein said foot has an opening therethrough for receiving said ground spike for anchoring the base member on a turf playing field.

20. A goal for use on a playing field for teaching skills to a player, comprising a pair of base members positioned in laterally spaced apart relation to one another, each including a foot having a lower side for engaging the playing field and a socket for receiving an upright portion of a hoop member, a hoop member supported by said pair of base members and including respective upright portions extending from said socket of said base members and a medial portion extending laterally between and interconnecting said upright portions with said upright portions and said medial portion defining a target opening, said hoop member comprising two substantially identically shaped and interchangeable pieces releasably fitted together to form said pair of upright portions and said medial portion, each of said pieces including a respective one of said upright portions and a corresponding half of said medial portion, said corresponding halves including mating surfaces and cooperating integrally formed snap-fit releasable fasteners.

* * * * *